US009057586B2

(12) United States Patent
Wagner et al.

(10) Patent No.: US 9,057,586 B2
(45) Date of Patent: Jun. 16, 2015

(54) ACTUATION DEVICE FOR ADJUSTING OR SETTING A PARAMETER OF AN OPTICAL DEVICE INCLUDING A TELESCOPIC SIGHT

(71) Applicant: Carl Zeiss Sports Optics GmbH, Wetzlar (DE)

(72) Inventors: Thomas Wagner, Wettenberg (DE); Hermann Theisinger, Wetzlar-Steindorf (DE); Kathrin Pfeiffer, Giessen (DE)

(73) Assignee: Carl Zeiss Sports Optics GmbH, Wetzlar (DE)

( * ) Notice: Subject to any disclaimer, the term of this patent is extended or adjusted under 35 U.S.C. 154(b) by 168 days.

(21) Appl. No.: 13/791,674

(22) Filed: Mar. 8, 2013

(65) Prior Publication Data

US 2013/0232846 A1 Sep. 12, 2013

Related U.S. Application Data

(60) Provisional application No. 61/608,273, filed on Mar. 8, 2012.

(30) Foreign Application Priority Data

Mar. 8, 2012 (DE) ..... 20 2012 002 286 U

(51) Int. Cl.
*F41G 1/38* (2006.01)

(52) U.S. Cl.
CPC ..... *F41G 1/38* (2013.01)

(58) Field of Classification Search
USPC ..... 42/115, 119, 120, 122, 124, 125, 126, 42/135, 136, 137, 138, 139; 74/553; 33/298; 359/425, 427, 428; 356/252
See application file for complete search history.

(56) References Cited

U.S. PATENT DOCUMENTS

| | | | | |
|---|---|---|---|---|
| 3,037,287 | A | 6/1962 | Glatz et al. | |
| 6,691,447 | B1 | 2/2004 | Otteman | |
| 6,772,550 | B1 * | 8/2004 | Leatherwood | 42/119 |
| 7,415,791 | B2 * | 8/2008 | Williams et al. | 42/122 |
| 7,578,091 | B2 | 8/2009 | Klepp et al. | |
| 7,581,346 | B2 * | 9/2009 | Klepp et al. | 42/122 |

(Continued)

FOREIGN PATENT DOCUMENTS

| | | | |
|---|---|---|---|
| DE | 288 213 | A5 | 3/1991 |
| DE | 20 2006 003 770 | U1 | 6/2006 |

OTHER PUBLICATIONS

English translation of the search report of the German Patent Office dated Feb. 5, 2013 in German patent application 20 2012 002 286.5 on which the claim of priority is based.

*Primary Examiner* — Jonathan C Weber
(74) *Attorney, Agent, or Firm* — Walter Ottesen P.A.

(57) ABSTRACT

An actuating device for setting an optical parameter of an optical device including a telescopic sight. The actuating device includes a first coupling part rotatable about a rotation axis and an index element pushable onto the first coupling part for assuming an operating position. A guide arrangement guides the index element on the first coupling part and is configured to permit a push-on of the index element in the direction of the rotation axis and to permit a twisting of the index element relative to the first coupling part at least in a direction perpendicular to or tangential to the rotation axis. A second coupling part is configured to provide friction forces counteracting a twisting of the index element relative to the first and second coupling parts when the index element is in the operating position thereof.

23 Claims, 7 Drawing Sheets

(56) References Cited

U.S. PATENT DOCUMENTS

| | | | | |
|---|---|---|---|---|
| 7,612,952 | B2 * | 11/2009 | Schafer | 359/813 |
| 7,934,335 | B2 * | 5/2011 | Halverson | 42/137 |
| 7,937,879 | B2 | 5/2011 | Hamilton | |
| 7,958,665 | B2 * | 6/2011 | Hamilton | 42/119 |
| 8,006,429 | B2 * | 8/2011 | Windauer | 42/122 |
| 8,516,736 | B2 * | 8/2013 | Windauer | 42/122 |
| 8,670,179 | B2 * | 3/2014 | Windauer | 359/428 |
| 8,848,287 | B2 * | 9/2014 | Schmitt et al. | 359/429 |
| 2004/0144013 | A1 | 7/2004 | Leatherwood | |
| 2007/0240356 | A1 * | 10/2007 | Klepp et al. | 42/122 |
| 2008/0066364 | A1 * | 3/2008 | Klepp et al. | 42/122 |
| 2008/0289239 | A1 | 11/2008 | Menges et al. | |
| 2009/0064561 | A1 * | 3/2009 | Piltonen | 42/119 |
| 2009/0241399 | A1 * | 10/2009 | Hamilton | 42/119 |
| 2011/0100152 | A1 | 5/2011 | Huynh | |
| 2011/0271577 | A1 * | 11/2011 | Davidson | 42/122 |
| 2012/0266515 | A1 * | 10/2012 | Hamilton | 42/119 |

* cited by examiner

ACTUATION DEVICE FOR ADJUSTING OR SETTING A PARAMETER OF AN OPTICAL DEVICE INCLUDING A TELESCOPIC SIGHT

CROSS REFERENCE TO RELATED APPLICATIONS

This application claims priority of U.S. provisional application Ser. No. 61/608,273, filed Mar. 8, 2012 and German patent application no. 20 2012 002 286.5, filed Mar. 8, 2012, and the entire content of both applications is incorporated herein by reference.

BACKGROUND OF THE INVENTION

Generic actuation devices, which are also referred to as a quick-adjustment sight or as adjustment turrets, with one or more index elements that can be slid on are often used in telescopic sights for setting the sight or target marks. In the process, scales applied to the index elements generally display a defined twist of the actuation member relative to a main, body of the actuation device. This defined twist can bring about an associated displacement, preferably in terms of height, and hence in the perpendicular direction, and in terms of the lateral direction, and hence in the horizontal direction, of the sight or the target mark, which serves to correct the ballistic trajectory of a projectile body.

Here, the scaling can be calibrated for a specific type of weapon and ammunition, and the scaling on the index element can indicate distances to target objects. If this distance is set on the calibrated scale, the associated displacement of the sight or the target mark, ensures that the determined point of impact, modified by the ballistic trajectory of the projectile body, once again corresponds to the sight or the target mark.

To this end, for example, annular, index elements were conventionally slid onto a coupling part of an actuation device in order to provide such a seals for correcting the ballistic trajectory of a projectile.

An actuation device for a telescopic sight, as mentioned at the outset, which enables a multiple zero position, that is, a zero position for a number of distances and/or for different ballistics properties of different projectiles and/or different gun barrels, et cetera, is described in United States patent application publication 2004/0144013 A1. This actuation field has a plurality of marker flags, which are arranged in rotatable fashion in the actuation device. Here, the actuation device is embodied in the form of a knob which consists of a plurality of disc-like elements which are arranged about the rotation axis of the device. The flags are applied to flat, discs, which are arranged between disc-like elements of the knob and can be displaced in a setting mode of the actuation device, that is, the disks on which the flags are arranged can be twisted about the rotation axis without the target mark itself being adjusted in the process. In the operating mode, after zeroing to different distances, calibrations, loads, barrels et cetera, the flags are fixed in their set position by virtue of the knob, that is, the discs forming the knob, being screwed against one another or fixed in another way, as a result of which the flag discs are clamped between the discs of the knob and are also moved when the knob is twisted.

However, a disadvantage of this embodiment is that, in order to adjust the individual flags, the knob has to be "loosened", that is, the knob discs become slightly displaceable along the rotation axis by loosening a fixation, as a result of which the flags, or the discs carrying the flags, loosen and it becomes possible to twist these. However, to this end, it is necessary, firstly, to loosen the turret in an independent work step and, secondly, all flags become loose again as a result of this loosening—this is particularly disadvantageous—and so it is quite easily possible that already set flags are inadvertently displaced.

However, according to U.S. Pat. No. 7,578,091, this disadvantage should be avoided by virtue of, according to the invention, the outer surface(s) of the index element(s) being recessed compared to the lateral surface of the knob in the direction of the rotation axis of the knob and the one index element or the number of index elements in the recess(es) being permanently rotatable. However, this can result in unwanted adjustments.

According to United States patent application publication 2008/0289239, this should be prevented by an actuation device for setting the position of a target mark in a telescopic sight, with a coupling part which is rotatable about a rotation axis and onto which at least one index element can be slid, in which the actuation device has a guide device for guiding the index element on the coupling part, which guide device renders it possible to slide the index element onto the coupling part in the direction of the rotation axis of the coupling part and prevents the index element from being twisted relative to the coupling part in the state where it is completely and/or partly slid onto the coupling part, at least in a direction perpendicular or tangential to the rotation axis, preferably in all directions. However, it is disadvantageous in the case of this actuation device that the guide device for guiding the index element does not allow arbitrarily fine but only incremented twists of the index element prior to it being slid on. This only allows positions of the index element corresponding to the incremental values to be selected prior to the index element being slid on, and these positions remain fixed during the sliding on and thereafter. Finer adjustments than those corresponding to the respective increments are not possible. Furthermore, after sliding on the index element, it is no longer possible belatedly to adjust or refine the settings, for example if conditions change during the hunt.

A device for quickly adjusting the sight of a firearm can be gathered from DE 20 2006 003 770 U1, in which an actuation device of the generic type mentioned at the outset can be adjusted in fixedly prescribed increments. This adjustment can be undertaken after a spring-pretensioned cap was lifted slightly, and the adjusted position can be securely maintained after the lifted cap was lowered once again in the incrementally adjusted position thereof.

SUMMARY OF THE INVENTION

The actuation device of the invention provides for adjusting or setting a parameter of an optical device, in particular a quick-adjustment sight for a telescopic sight, which allows both a non-incremented adjustment and subsequent adjustment, and also provides sufficient anti-twist protection against an inadvertent adjustment.

According to the invention, this is achieved by an actuation device for setting an optical parameter, in particular the position of a mark or more particularly the position of a target mark in a telescopic sight, with a first coupling part which is rotatable about a rotation axis and onto which at least one index element can be slid, in which the actuation device has a guide arrangement for guiding the index element on the coupling part, in which the guide device for guiding the index element renders it possible to slide the index element onto the coupling part in the direction of the rotation axis of the coupling part and allows the index element to be twisted, relative to the coupling part in the state where it is completely and/or partly slid onto the coupling part, at least in a direction perpendicular to the rotation axis, and, in the operating position of the index element, a further, preferably at least partly elastic coupling part provides friction forces which counteract the index element being twisted relative to the first and the further coupling part.

Advantageously, the first coupling part has a substantially cylinder barrel-shaped external contour and, furthermore advantageously, the further coupling part has a substantially annular design since this simplifies precise fitting of the two coupling parts relative to one another and supports the precise joining thereof.

By means of an apparatus which prevents the further coupling part from being twisted relative to the first coupling part, the further coupling part can be provided with the function, of a very precise entrainer, since the latter can, in a manner secured against twisting, then also exert defined fractional forces on the index element.

If the device for preventing the further coupling part from being twisted relative to the first coupling part comprises a recess in the first coupling part and a projection in the further coupling part, it can, extending in the axial direction, ensure simple joining and the precise untwistable seat in a permanent fashion.

Frictional or friction forces can be applied by the further coupling part, which is secured against twisting, onto the index element in an advantageous fashion if the further coupling part, at least in regions thereof, has a section comprising an elastomer which, in the operating position of the index element, rests against the latter in an interlocking manner.

Advantageously, the section, which comprises an elastomer, at least in regions of the further coupling part, has a Shore hardness of 40 to 80, preferably of 50 to 70, most preferably of approximately 60.

A defined and structurally practical embodiment is provided if the section, which comprises an elastomer at least in regions, of the further coupling part protrudes axially.

In a particularly advantageous embodiment, the section, which comprises an elastomer at least in regions, of the further coupling part forms an axially protruding annular shoulder and the section is preferably held on an annular non-elastomeric support. As a result of this, the elastomeric region rests in a defined fashion against a section which only deforms a little and it follows that it can provide friction forces that can be set very precisely because these friction forces are substantially only still produced by the elastic restoration forces of the elastomer which is deformed, more particularly axially compressed, in a defined manner.

It is advantageous if, in the process, the annular, non-elastomeric support comprises a metallic material, a fiber material, in particular a carbon fiber or optical fiber material, on which the elastomer is formed, in particular sprayed thereon or held by means of an attachment means.

To this end, the attachment means can comprise an adhesive, an interlock and/or mechanical attachment elements, which can provide a permanent connection which remains secure during operation.

As a result of the precise hold of the elastomer, the axially protruding section, which comprises an elastomer at least in regions, of the further coupling part can, in the operating position thereof, be compressed by the index element, at least, in part or in regions thereof. In the process, the phrase "operating position" will be defined more precisely below in the specific description of the preferred embodiments.

If the axially protruding section, which comprises an elastomer at least in regions, of the further coupling part, in the operating position thereof in which the index element is compressed, at least in part or in regions thereof, provides a sealing effect which reduces the ingress of, in particular particulate, contaminants and, optionally, the emergence of lubricants, it is possible to support a permanent precise function because in this case the wear-and-tear is reduced at the internal contact surfaces and, moreover, to bring about a defined change or further matching of the friction values by means of a lubricant filling. A very viscous fat could counteract the inadvertent adjustment by virtue of the fact that corresponding rheology ensures that the viscous resistance is very high for quick adjustments and much lower for slower adjustments. As a result of this, the effective actuating power can be designed to be very agreeable to the sense of touch; it is possible to create a soft, very precise motion sequence which can be adjusted very easily in the case of slow adjustment processes and can only be adjusted with more difficulties in the case of fast movement changes.

It is possible, and advantageous in the same way, to attach an elastomer, at least in regions, to the side of the index element lying opposite to the further actuation device in the operating position thereof, which elastomer preferably has the form of an annular shoulder and, in the operating position of the index element, provides a sealing effect which reduces the ingress of, in particular particulate, contaminants and, optionally, the escape of lubricants.

Instead of the elastomer at the index element, or in addition thereto, an elastomer can also, in likewise the same advantageous fashion, be attached, at least in regions, to the first coupling part in the region of the seating flange for the index element, which elastomer preferably has the form of an annular shoulder and provides a sealing effect which reduces the ingress of, in particular particulate contaminants and, optionally, the escape of lubricants.

If the first coupling part defines a stop for a holding element of the further coupling part and hence for the axial loading of the index element, by means of which the holding element can be arranged in a defined axial position, this can set the degree of compression of the elastomeric region or regions in a defined fashion.

It is also advantageous if the first coupling part has a safety against inadvertent adjustment, which allows an incremental adjustment. Such a safety against adjustment is described in DE 20 2006 003 770 U1.

The index elements advantageously comprise an annular main body, on the outer jacket of which markings have been applied, which are associated with respective distances, and a plurality of index elements for respective sets of markings, which are associated with respective specific types of ammunition.

If the first coupling part is designed to have a longer axial extent and/or the corresponding index element is designed to be shorter, it is also possible for more than one index element to be arranged over one another and the intermediate layer of a corresponding further coupling part between two index elements ensures that when one index element is adjusted there is no unwanted adjustment of a neighboring index element.

By using a set of index elements and further coupling parts for an actuation device with a corresponding axial extent and comprising index elements, the markings of which are associated with corresponding specific types of ammunition, it is then possible to apply the index elements for different types of ammunition, on a single quick-adjustment sight.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
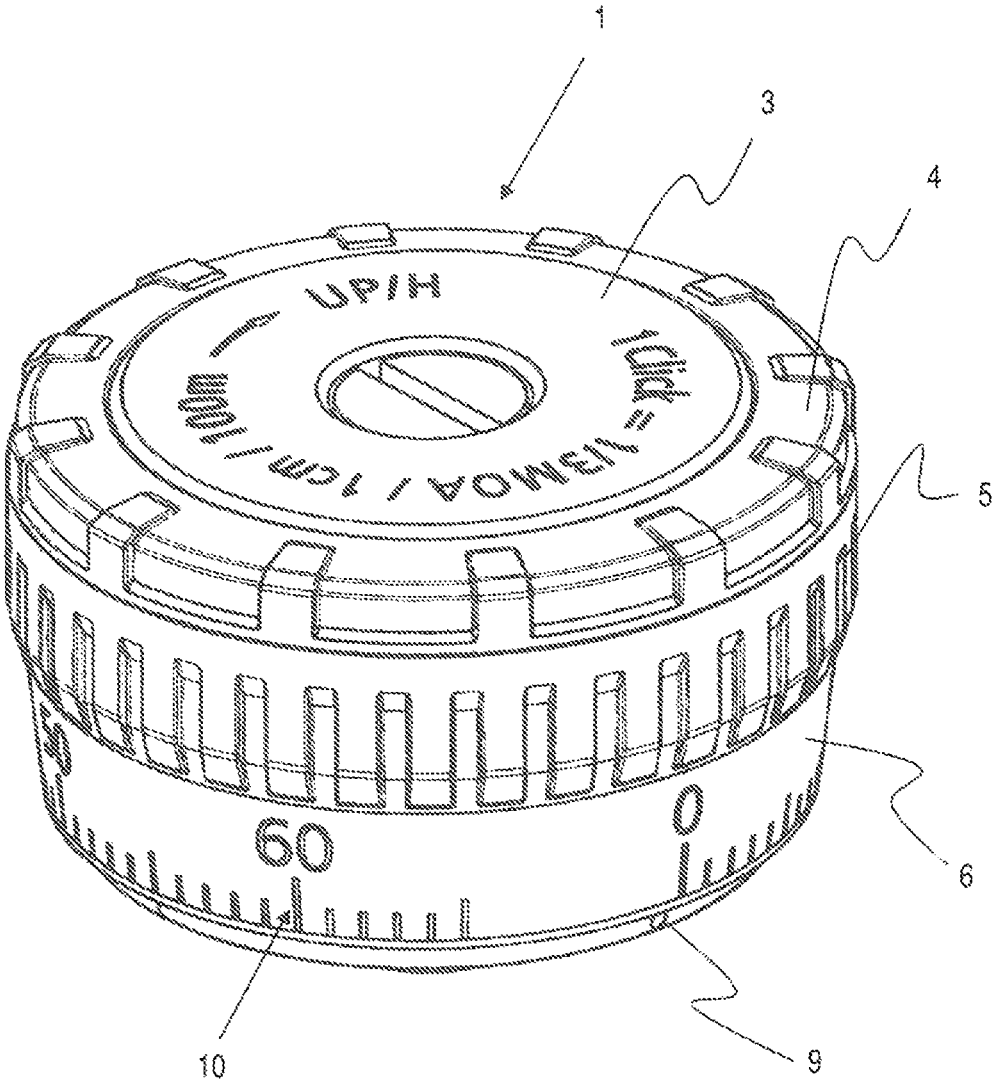
FIG. 1 is a perspective view from the front and top of a first embodiment of an actuation device according to the invention for setting an optical parameter, in particular, the position of a mark or, more particularly, the position of a target mark in a telescopic sight, in the operating position thereof or in the position assembled ready for use, without the associated telescopic sight.

In the following detailed description of the preferred embodiments, the phrase operating position is used a number of times. This phrase should refer to the assembled arrangement of all components of the actuation devices according to the invention, independently of whether the index elements thereof are adjusted, set, calibrated, modified or situated in an arbitrary position.

In the following text, reference is made to FIG. 1. In this view of a first embodiment of an actuation device 1 according to the invention for setting an optical parameter of an optical device, more particularly a telescopic sight 2, it is possible to identify, in the operating position thereof, a first coupling part 3, a holding element 4, a further coupling part 5 and an index element 6.

For the purposes of actuation, this actuation device 1 is rotatable about a rotation axis, as known to a person skilled in the art in this field and as is described in more detail in the utility model DE 20 2006 003 770 U1 which is incorporated herein by reference.

The first coupling part 3 forms a lower seat flange 7, on which the index element 6 is mounted and which is at a defined axial distance from an upper annular shoulder 8 of the first coupling part 3. Here, the axial direction denotes the direction which extends along the direction of the axis of symmetry of the substantially cylindrically symmetric actuation device 1.

On the outer side, a marking 9 has been applied in the region of the lower seat flange 7, which marking defines a reference point for the scale 10 applied to the index element 6 and renders it possible to identify the relative twist with respect to this reference point.

The subdivisions of the scale 10 can be linear or nonlinear and can, in particular, reproduce values associated with fixed distances for the zeroing used in each case to different distances, calibrations, assemblies, barrels, et cetera.

Furthermore, index elements 6 associated with corresponding different loads, barrels, et cetera, or else ammunitions and combinations of these can have a scale 10 associated with this particular combination.

Such an association for the index element 6 illustrated in FIG. 1 has been reproduced, only in an exemplary fashion therein, on the top side of the first coupling part.

Figure 2:
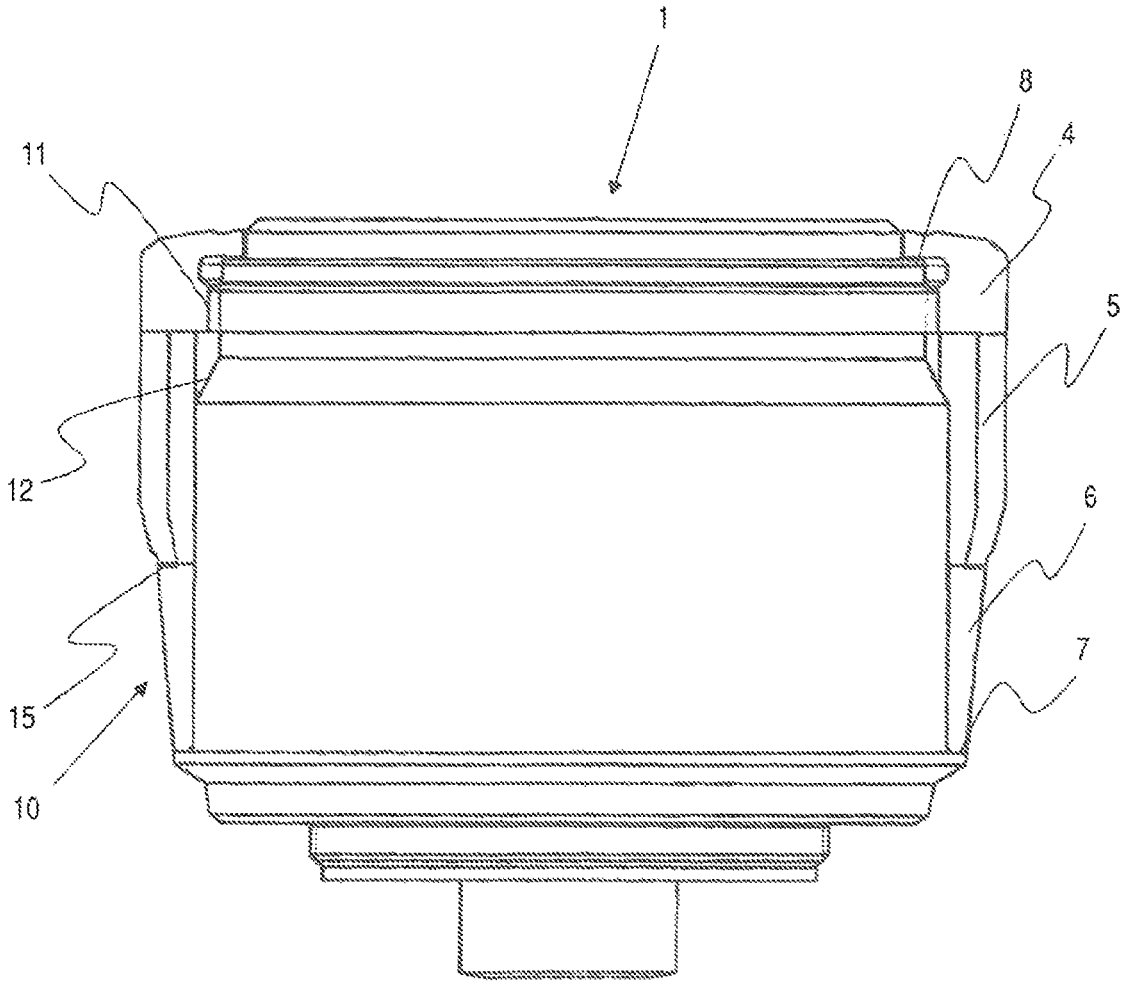
FIG. 2 is a cutaway plan view of the first embodiment shown in FIG. 1 of the actuation device according to the invention in a plan view from the front without the associated telescopic sight.
Figure 3:
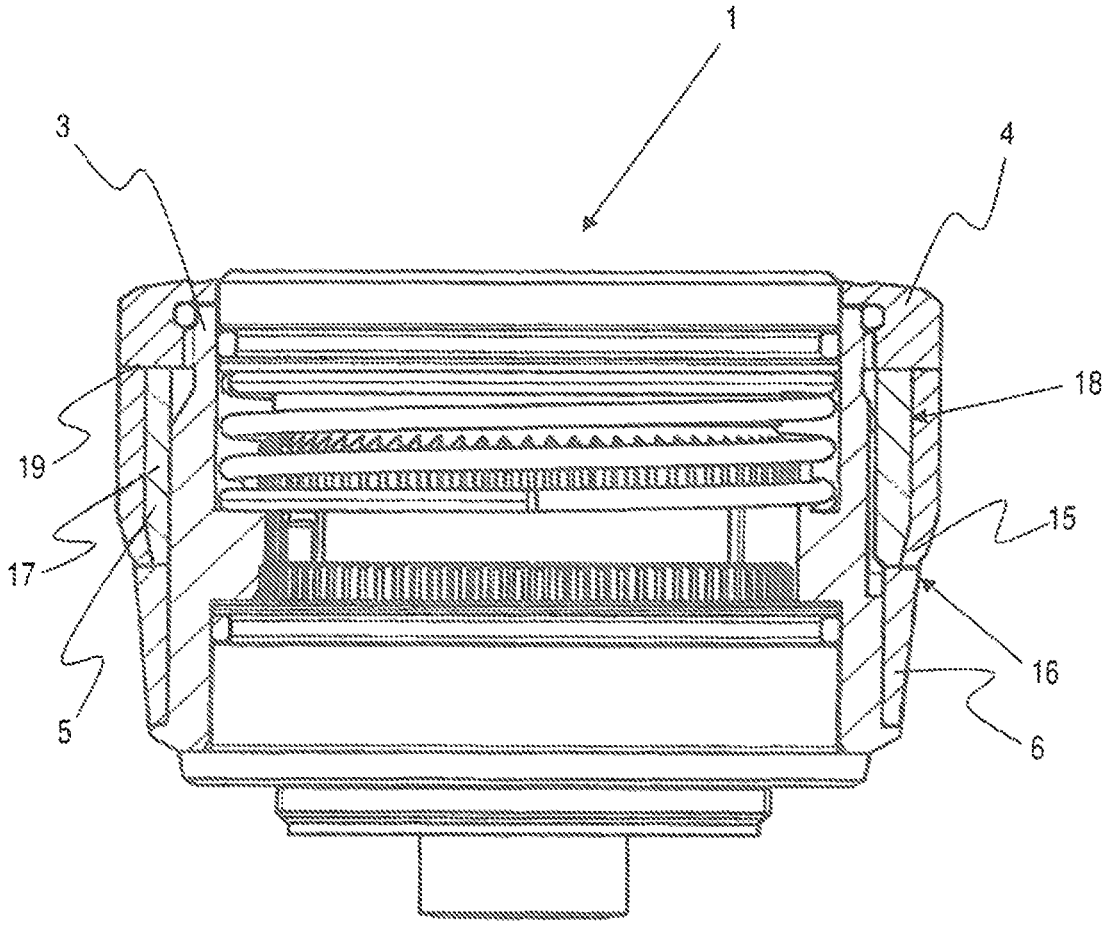
FIG. 3 is a further plan view, partly in section, of the embodiment of FIG. 1 of the actuation device according to the invention, in which part of the interior of the first coupling part has also been shown, in a plan view from the front, without the associated telescopic sight.

FIG. 2 shows a side elevation view, partly cutaway, of the first embodiment of FIG. 1 wherein it is possible to view the stacked arrangement of the index element 6 resting on the lower seat flange 7 and of the further coupling part 5 arranged thereover and of the holding element 4 which places this under axial pretension.

When assembling the components of the actuation device 1, the index element 6 is initially slid onto the first coupling part 3 until the latter rests on the lower seat flange 7. Thereupon, the further coupling part 5 is slid thereon over the first coupling part 3 and both the index element 6 and the further coupling part 5 are thereupon held by the holding element 4 in their operating positions. A cone 12 assists the assembly during this process.

As a result of this, the first coupling part 3, onto which the index element 6 can be slid, forms a guide device for guiding the index element 6 on the first coupling part 3 and this guide device for guiding the index element 6 renders it possible for the index element 6 to be slid onto the first coupling part 3 in the direction of the rotation axis of the first coupling part 3 and the index element 6 is allowed to be twisted relative to the first coupling part 3 in the state where it is completely and/or partly slid onto the first, coupling part 3, at least in a direction perpendicular or tangential to the rotation axis.

Figure 4:
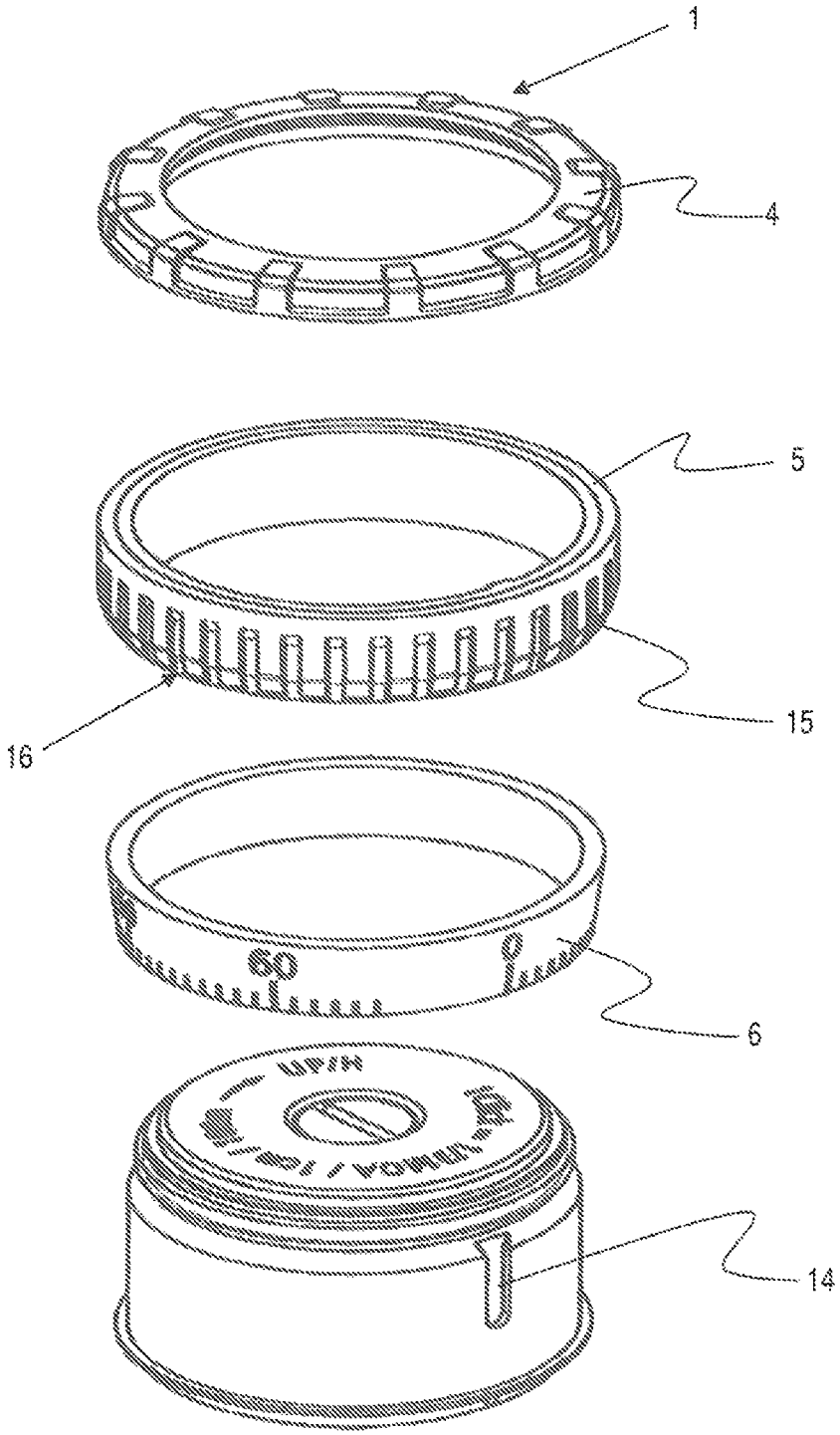
FIG. 4 is a perspective exploded view of the first embodiment of FIG. 1 showing the actuation device according to the invention, obliquely from the front and top.
Figure 5:
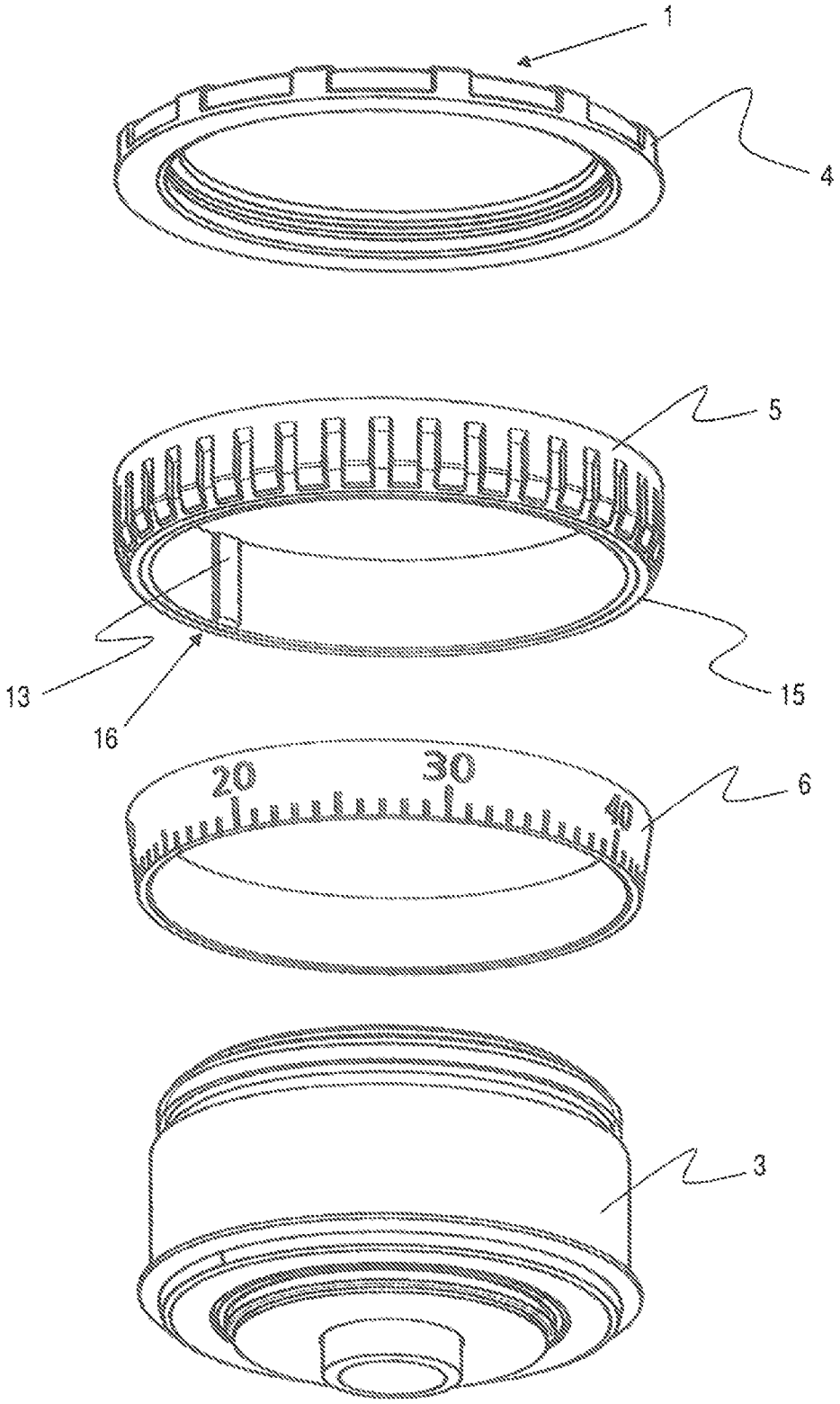
FIG. 5 shows a further perspective exploded view of the first embodiment of FIG. 1 showing the actuation device according to the invention, obliquely from the front and top and from a different lateral angle.
Figure 6:
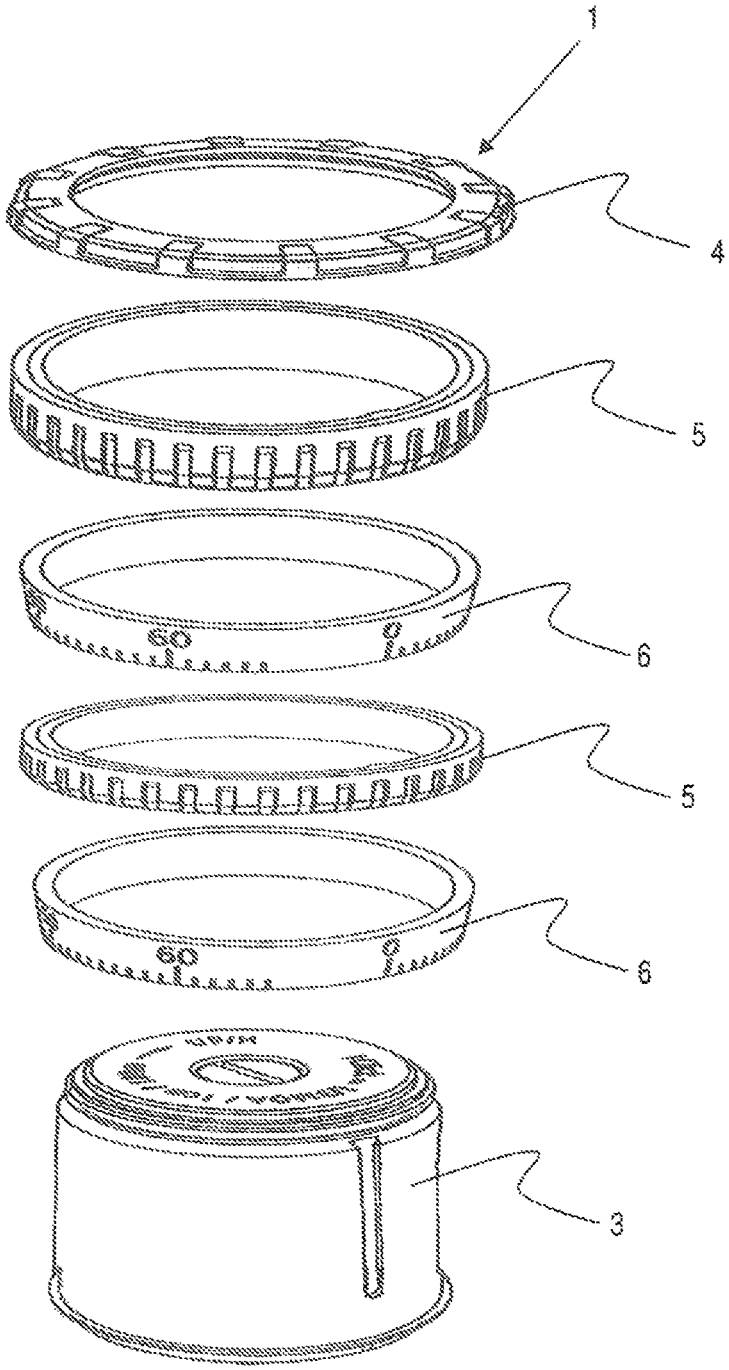
FIG. 6 is a view obliquely from the front and top of a second embodiment of an actuation device according to the invention, with a plurality of index elements and a plurality of further coupling parts, in the operating position thereof or in the position assembled ready for use, without the associated telescopic sight; and, FIG. 7 is a lateral view of a telescopic sight with two actuation devices attached thereto, which are respectively suitable for adjusting the height and the lateral position of a target mark or sight applied in the telescopic sight.

In this assembled, position, as can foe identified best from an overview of the exploded views of FIGS. 4 to 6, a projection or key 13 arranged on the further coupling part 5 engages into an associated slot 14 arranged on the outer circumference of the first coupling part 3 and thereby forms a device which is also referred to as an anti-twist device, which prevents the further coupling part 5 from twisting relative to the first coupling part 3.

The following text will describe how, in this operating position of the index element 6, the further coupling part 5, which preferably has an at least partly elastic design, provides friction, forces which counteract the index element 6 being twisted relative to the first coupling part 3 and the further coupling part 5.

As can be seen particularly well in FIG. 5, the further coupling part 5, at least in regions, has a section 15 comprising an elastomer which, in the operating position of the index element 6, rests against the latter in an interlocking manner, as can also, for example, be seen in FIG. 2.

This section 15, which comprises an elastomer at least in regions, of the further coupling part, more particularly the elastomer thereof, has a Shore hardness of 40 to 80, preferably of 50 to 70, most preferably of approximately 60.

As elastomers for this, use can preferably be made of, for example, NBR-PVC and, more particularly, thermoplastic styrene copolymer elastomers.

As shown, in FIG. 5, the section 15, which comprises an elastomer at least in regions, of the further coupling part 5 protrudes axially, particularly in the direction of the index element 6, and so it can, after sliding of the index element 6 onto the first coupling part 3, exert friction forces in contact with the latter, which friction forces counteract the index element, being twisted relative to the further coupling part 5 and, at least by means of the anti-twist device, also counteract the index element 6 being twisted relative to the first coupling part 3.

In a particularly preferred embodiment, the section 15, which comprises an elastomer at least, in regions, of the further coupling part 5 forms an axially protruding annular shoulder 16, by means of which uniform symmetric forces act upon the index element 6 and, moreover, particularly if this section 15 is compressed by the index element, at least in part or in regions thereof, a sealing effect is provided which reduces the ingress of, in particular particulate contaminants and, optionally, the escape of lubricants.

The elastomeric section 15 is preferably held on an annular non-elastomeric support 17, which comprises or consists of a metallic material, a fiber material, in particular a carbon fiber or optical fiber material, onto which the elastomer is formed, in, particular sprayed thereon or held by means of an attachment means 18. Here, the attachment means 18 can comprise an adhesive, an interlock and/or else mechanical attachment elements.

If, during the assembly of the individual components, the holding element 4 is screwed onto the first coupling part 3, the upper annular shoulder 8 of the first coupling part 3 forms an axial stop for the holding element 4, as a result of which a very precise axial displacement of the further coupling part 5 is brought about, the latter resting against the underside 19 of the holding element 4, and the axially protruding section 15, which comprises an elastomer at least in regions, of the further coupling part 5 is compressed by the index element 6, at least in part or in regions thereof.

Since the index element 6 has an axial extent that can be set in a defined fashion and can foe produced in a precise manner and since the lower seat flange 7 also forms an axially precisely defined stop for the index element 6, this can bring about a defined compression of the elastomeric section 15, by means of which the magnitude of the frictional forces can also be influenced.

Furthermore, a lubricant filling in the space between the first coupling part 3, index element 6 and further coupling part 5 can also bring about a defined change or further fitting of the friction values. By way of example, a very viscous fat can counteract inadvertent adjustment by virtue of the fact that corresponding theology ensures that the viscous resistance is very high for quick adjustments and much lower for slower adjustments.

Alternatively, or in addition thereto, an elastomeric, preferably axially protruding, region can also be arranged in a similar fashion on the underside of the index element 6 or on the seat flange 7 of the first coupling part 3, as shown for the further coupling part 5, in order thereby to achieve an improved seal and even higher operational stability.

In a further embodiment according to the invention, the index element can, as described above for the further coupling part, also have elastomeric sections, more particularly axially protruding annular shoulders, at both the upper and the lower edge section thereof and then also, in this embodiment, further elastomeric sections on further components could be unnecessary.

If, in a second preferred embodiment according to the invention which is illustrated in an exemplary fashion in FIG. 6, the first coupling part 3 is designed to be longer in the axial extent thereof and/or if the particular index element 6 has a shorter design, it is also possible to arrange more than one index element 6 one above the other and the intermediate layer of a corresponding further coupling part 5 between two index elements 6 ensures that when an index element 6 is adjusted there is no unwanted adjustment of a neighboring index element since every further coupling part 3 also has available the anti-twist device already described in detail.

By using a set of index elements and further coupling parts for an actuation device with a corresponding axial extent and comprising index elements, the markings of which are associated with corresponding specific types of ammunition, it is then possible to apply the index elements for different types of ammunition, loads, barrels, et cetera, on a single quick-adjustment sight.

In the preferred embodiments, the first coupling part 3 furthermore in each, case has a safety against inadvertent adjustment, which allows an incremental adjustment and which is described in a detailed fashion that can be understood by a person skilled in the art in the utility model DE 20 2006 003 770 U1 incorporated herein by reference.

Figure 7:
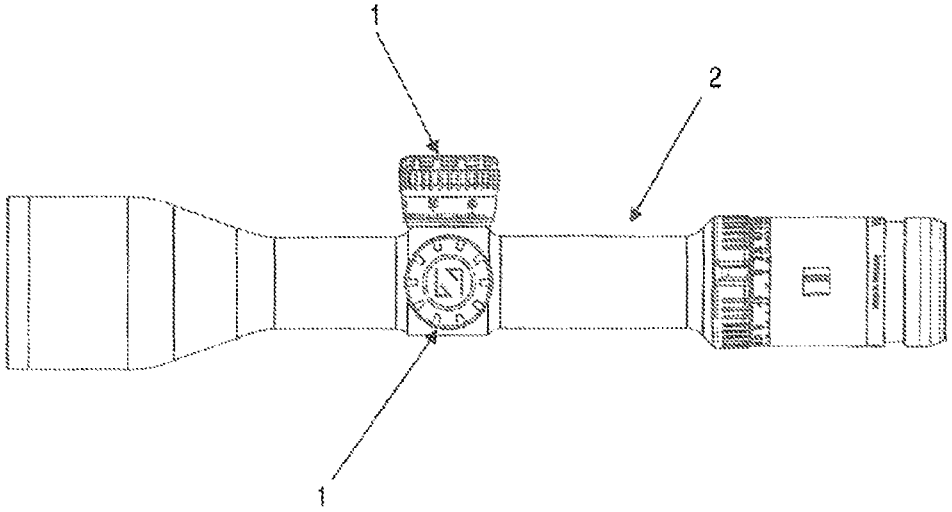

FIG. 7 shows, in an exemplary fashion, two actuation devices 1 according to the invention, in the operating position thereof or in the position assembled ready for use, in a fashion attached to an associated, telescopic sight 2. Using the actuation devices 1, it is, in each case possible, in a suitable manner, to set, calibrate or adjust in a defined manner the height and/or the lateral position of a target mark attached in the telescopic sight or of a sight, in particular by using the scale 10 of a respective index element 6.

It is understood that the foregoing description is that of the preferred embodiments of the invention and that various changes and modifications may be made thereto without departing from the spirit and scope of the invention as defined in the appended claims.

What is claimed is:

1. An actuating device for setting an optical parameter, the actuating device comprising:

a first coupling part rotatable about a rotation, axis;

an index element pushable onto said first coupling part for assuming an operating position;

a guide arrangement for guiding said index element on said first coupling part;

said guide arrangement being configured to permit a push-on of said index element onto said first coupling part in the direction of said rotation axis and to permit, in the partially pushed-on or completely pushed-on state on said first coupling part, a twisting of said index element relative to said first coupling part at least in a direction perpendicular to or tangential to said rotation axis; and, a second coupling part configured to provide friction forces counteracting a twisting of said index element relative to said first and second coupling parts when said index element is in said operating position thereof, wherein said second coupling part is, at least in part, elastic.

2. The actuating device of claim 1, wherein said first coupling part has an essentially cylinder-shaped outer contour.

3. The actuating device of claim 2, wherein said second coupling part is configured to have an essentially annular shape; and, wherein said actuating device further comprises a preventive unit for preventing a twisting of said second coupling part relative to said first coupling part.

4. The actuating device of claim 3, wherein said preventive unit includes a recess in said first coupling part and a projection in said second coupling part.

5. The actuating device of claim 2, wherein said second coupling part has a section comprising an elastomer and said section lies form-tight against said index element in said operating position thereof.

6. The actuating device of claim 5, wherein said section has a Shore hardness of 40 to 80.

7. The actuating device of claim 5, wherein said section has a Shore hardness of 50 to 70.

8. The actuating device of claim 5, wherein said section has a Shore hardness of approximately 60.

9. The actuating device of claim 5, wherein said section of said second coupling part projects outwardly in the direction of said rotation axis.

10. The actuating device of claim 5, wherein said section of said second coupling part is configured to define an axially projecting annular shoulder; and, said second coupling part includes an annular-shaped non-elastomeric support for holding said section thereof.

11. The actuating device of claim 10, wherein said support is made of a metal or a fiber material; and, said elastomer of said section of said second coupling part is formed on said support.

12. The actuating device of claim 11, wherein said section is formed on said support by being sprayed thereon.

13. The actuating device of claim 11, wherein said second coupling part has an operating position and said section of said second coupling part is configured to project axially and is compressed by said index element when said second coupling part is in said operating position thereof.

14. The actuating device of claim 13, wherein said section is compressed by said index element in said operating position of said second coupling part whereat said section provides a sealing effect which reduces the penetration of particulate contaminants and the escape of lubricants.

15. The actuating device of claim 14, wherein an ancillary elastomer is arranged on the side of said index element which lies opposite said second coupling part; and, said ancillary elastomer is in the shape of an annular shoulder and, in the operating position of said index element, said annular shoulder provides a sealing effect which reduces the penetration of particulate contaminants and the escape of lubricants.

16. The actuating device of claim 14, wherein said first coupling part has a seating flange for accommodating said index element; an ancillary elastomer arranged on said seating flange in the form of an annular shoulder; and, said annular shoulder provides a sealing effect to reduce the penetration of particulate contaminants and the escape of lubricants.

17. The actuating device of claim 10, wherein said support is made of a metal or a fiber material; and, said elastomer of said section is held on said support by attachment means.

18. The actuating device of claim 17, wherein said attachment means is an adhesive, a form-tight connection and/or a mechanical attachment element.

19. The actuating device of claim 1, further comprising a holding element; and, said first coupling part having a stop for said holding element via which said holding element can be arranged in a defined axial position.

20. The actuating device of claim 1, wherein said index element comprises an annular-shaped base body defining an outer surface having a plurality of markings applied thereto corresponding to respective distances.

21. The actuating device of claim 1, wherein said actuating device comprises a plurality of said index elements corresponding to respective specific types of ammunition.

22. The actuating device of claim 1, wherein said optical parameters include the position of a mark or the position of a target mark of a telescopic sight.

23. A telescopic sight comprising:

an actuating device for setting an optical parameter;

the actuating device including:

a first coupling part rotatable about a rotation axis;

an index element pushable onto said first coupling part for assuming an operating position;

a guide arrangement for guiding said index element on said first coupling part;

said guide arrangement being configured to permit a push-on of said index element onto said first coupling part in the direction of said rotation axis and to permit, in the partially pushed-on or completely pushed-on state on said first coupling part, a twisting of said index element relative to said first coupling part at least in a direction perpendicular to or tangential to said rotation axis; and, a second coupling part configured to provide friction forces counteracting a twisting of said index element relative to said first and second coupling parts when said index element is in said operating position thereof, wherein said second coupling part is, at least in part, elastic.

* * * * *

UNITED STATES PATENT AND TRADEMARK OFFICE

CERTIFICATE OF CORRECTION

PATENT NO. : 9,057,586 B2
APPLICATION NO. : 13/791674
DATED : June 16, 2015
INVENTOR(S) : T. Wagner et al.

It is certified that error appears in the above-identified patent and that said Letters Patent is hereby corrected as shown below:

In the specification

In Column 1:
Line 37: delete "seals" and substitute -- scale -- therefor.

In Column 3:
Line 16: delete "fractional" and substitute -- frictional -- therefor.

In Column 6:
Line 38: delete "assembled," and substitute -- assembled -- therefor.
Line 38: delete "foe" and substitute -- be -- therefor.
Line 64: delete "shown," and substitute -- shown -- therefor.

In Column 7:
Line 3: delete "element," and substitute -- element -- therefor.
Line 35: delete "foe" and substitute -- be -- therefor.
Line 46: delete "theology" and substitute -- rheology -- therefor.

In Column 8:
Line 22: delete "associated," and substitute -- associated -- therefor.

In the claims

Line 36, Claim 1: delete "rotation," and substitute -- rotation -- therefor.

Signed and Sealed this
First Day of December, 2015

Michelle K. Lee

Michelle K. Lee
*Director of the United States Patent and Trademark Office*